United States Patent [19]

Kojima et al.

[11] 4,062,177

[45] Dec. 13, 1977

[54] SPUN YARN AND PROCESS FOR MANUFACTURING THE SAME

[75] Inventors: Teiryo Kojima; Shin-ichi Kitazawa, both of Ohtsu, Japan

[73] Assignee: Toray Industries, Inc., Tokyo, Japan

[21] Appl. No.: 696,708

[22] Filed: June 16, 1976

[51] Int. Cl.[2] ..... D02G 3/04

[52] U.S. Cl. ..... 57/140 BY; 57/2; 57/140 R

[58] Field of Search ..... 57/2, 140 R, 140 BY

[56] References Cited

U.S. PATENT DOCUMENTS

| | | | |
|---|---|---|---|
| 3,831,3 60 | 8/1974 | Howath | 57/2 |
| 3,835,637 | 9/1974 | Russell | 57/140 BY |
| 3,946,548 | 3/1976 | Hino et al. | 57/2 X |
| 3,967,441 | 7/1976 | Yasuzuka et al. | 57/2 X |

*Primary Examiner*—Richard C. Queisser
*Assistant Examiner*—Charles Gorenstein
*Attorney, Agent, or Firm*—Armstrong, Nikaido & Marmelstein

[57] ABSTRACT

This invention relates to a novel spun yarn composed of staple fibers only and having the average number of fibers in cross section and the rate of yarn evenness being within a limited range, and a process for manufacturing the same directly from continuous multi-filament yarn.

7 Claims, 9 Drawing Figures

SPUN YARN AND PROCESS FOR MANUFACTURING THE SAME

BACKGROUND OF THE INVENTION

This invention relates a novel spun yarn having a unique configuration and a process for the manufacture thereof. More particularly, this invention relates to a novel spun yarn which improve efficiency in the manufacture of knitted and woven fabrics and impart useful properties to the knitted and woven fabrics and an effective process for the manufacture thereof.

In general, conventional yarns to be used for the manufacture of knitted and woven fabrics are classified into spun yarns and filament yarns.

Although conventional spun yarns have good bulkiness and are accordingly soft and warm featured, they are limited in uniformity of yarn evenness. Especially, when fine yarn is manufactured from fibers of coarse denier, the uniformity of yarn evenness remarkably becomes worse. Thus, knitted and woven fabrics made of conventional spun yarns are lacking in the uniformity of the surface and, especially, it is difficult to manufacture knitted and woven faberics having high gauge.

On the other hand, conventional filament yarns have good uniformity and even the finer yarns can be manufactured. However, they are lacking in bulkiness and, therefore, knitted and woven fabrics made of them having uniform surface though, are of cold and slim featured. Much research effort has been directed and many methods have been proposed to remove these defects of the conventional yarns.

Conventional methods of obtaining spun yarns are clasified into card system and tow system, and the tow system includes perlock system, tarbo stapler system, converter system and direct spinning system. In the card system that is the mechanism of making spun yarn to open and rearrange staple fibers from fiber mass in which staple fibers are arranged randomly, the obtained spun yarn is limited in evenness and it is said that the limit of evenness of spun yarn corresponds to that in random slivers.

In other words, when the average number of fibers in cross section of spun yarn is N, the rate of yarn evenness in randon slivers, $CV_o$, is the following.

$$CV_o = 100/\sqrt{N}$$

And the rate of yarn evenness in the spun yarn obtained by the card system is always beyond the value of the above equation.

The rate of yarn evenness means a coefficient of variation in unevenness of finess of spun yarn, and the lower the value, the better the evenness of yarn. In the tow system, the method of obtaining staple fibers from tow is either to tear off the tow or to cut the tow by a knife.

In the latter case, the end portions of staple fibers obtained are centralized at a specific position along the length of sliver, and therefore a useful yarn can not be obtained. In order to disperse the cut end portions of staple fibers, doubling and drafting are repeated, so that the uniformity of finess of the obtained spun yarn is almost equal to the uniformity in spun yarn obtained by the card system. In the former case or the method of obtaining sliver by tearing off, the uniformity of thickness of the sliver is deemed as follows. The number of filaments, which compose a supplying tow, is represented as n, and it is supposed that all of the filaments are of the same finess and elongation of each filament at tearing off is perfectly recovered. When the tow is torn off at drafting of D times to obtain sliver, the average number of fibers in cross section of two becomes $n/D$. Further, supposing that the cutting of filaments randomly takes place, probability $p$ of existing of one of the filaments, in the optional cross section of sliver becomes 1/D and probability $q$ of non-existing of it becomes $(1-p)$.

$$p = 1/D$$

$$q = 1 - p$$

The number of fibers in cross section of sliver is obtained by adding them n times, and as a result of binomial distribution, probability $P(r)$ of the number of fiber in cross section being r becomes the following.

$$P(r) = nCrP^r q^{n-r}$$

As dispersion of data at binomial distribution is $n \cdot p \cdot q$ and the average value is $n \cdot p$, CV% of data becomes the following.

$$(\sqrt{n \cdot p \cdot q}/n \cdot p) \times 100 = \sqrt{(q/n \cdot p)} \times 100 = \sqrt{(D-1/n)} \times 100\ (\%)$$

In other words, when a tow, which is composed of $n$ pieces of filaments, is teared off at drafting of D times to obtain sliver, supposing that the cutting of filaments randomly takes place, the number of fibers in cross section, CV%, of becomes $$\sqrt{(D-1/n)} \times 100\%.$$

On the other hand, CV% of the above mentioned random sliver is $(100/\sqrt{N})\%$. N is the average number of fibers in cross section, corresponding to $n/D$ in the case of obtaining sliver by tearing off the tow, and accordingly the ratio of CV% to that of the tearing off case becomes the following.

$$\frac{\sqrt{\frac{D-1}{n}} \times 100}{\sqrt{\frac{D}{n}} \times 100} = \sqrt{\frac{D-1}{D}}$$

Generally, in the tearing off case, the drafting ratio D is much greater than 1 and the value of above equation is almost equal to 1. Therefore, even in the tearing off case, the uniformity of finess in the obtained spun yarn is at most the same as the uniformity in the random sliver. As is mentioned above, the conventional spinning methods are limited in uniformity of thickness in the obtained spun yarns.

On the other hand, many methods have been proposed to impart hand touchness like spun yarn to filament yarns as shown in Japanese Patent Publication No.36-6592, 40-19697 and 49-133639, in which methods of making nap on the surface of filament yarn are proposed. However, the spun like yarns obtained by these methods have nap on the surface of yarn and are apparently similar to spun yarn, but bulkiness and softness of them, and hand touchness of the surface of knitted and woven fabrics made of them are greatly inferior to those of spun yarn.

As an another method of manufacturing spun like yarn made of filament yarn, Japanese Patent Laying Open No.50-154550 has been proposed. According to this method, an unoriented polyester yarn is subjected to drafting and heat treatment at a specific condition to impart weak points in places to the filaments and tearing off the yarn to obtain spun-like yarn.

The end portions of fibers obtained by this method are not only on the surface of yarn but also inside the yarn and, therefore, the yarn obtained by this method is more similar to spun yarn than those obtained by above mentioned conventional methods. However, according to this method, weak points are quite randomly existed in each filament, so that the length of fibers obtained is quite irregular.

Well known methods for manufacturing the blended yarn are a method of blending plural staple fibers at a scutching process and a method of blending plural slivers at a drawing process or gilling process. However, the blended yarns obtained by these methods have problems in uniformity of finess and productivity.

Covered yarn is a yarn in which the function of core yarn component is to improve the mechanical properties of yarn (such as stretchability, bending strength) and the function of covering component is to improve the feeling properties of yarn (such as color, hand touchness). A typical known method for manufacturing covered yarn is a method in which a core yarn is fed onto a front roller of ring spinning frame, discharging it together with a drafted fleece from the front roller, twisting and taking up the yarn thus produced.

However this method is not efficient because of using a roving yarn by way of long spinning processes. Also, in this method, a fleece, which is produced by drafting the roving yarn, is limited in uniformity of thickness, so that uneven covering tends to appear to lower the quality of knitted and woven fabrics made of the covered yarn.

Heretobefore, it has been known that doubling yarn is directly manufactured by using pot spinning frame, in which a drafted roving yarn is fed into a cylindrical pot which is rotating at a high speed to twist, and when the volume of yarn in the pot reaches at a predetermined one, the yarn is discharged together with a separate yarn, and the doubling and twisting yarn thus produced is taking up as a cheese. This method is superior to the methods using ring spinning frame which require four steps of spinning, rewinding, doubling and twisting.

However, this method has several problems in practice.

First problem is that it is required to stop once the rotation of the pot at the time of yarn breakage. As is well known, while pot in the spinning process, the fiber bundle is pressed against the inner wall surface of the pot by the centrifugal force action, but when stopped the rotation of pat, the fiber bundle inside the pot get out of shape. Accordingly, when yarn breakage occurs in the pot, the whole yarn therein becomes yarn waste.

Second problem is that it is required to rewind the winded yarn in order to remove yarn shortcomings such as slub and nep. Especially it is an essential problem when staple fiber is used as a starting material for spun yarn. Moreover, in case of removing of yarn shortcomings from doubling yarn, the knot portion of yarn is enlarged.

As is mentioned above, the conventional pot spinning methods have various essential problems and, especially, it is very difficult to prevent lowering of efficiency and yield caused by occurrence of yarn breakage.

DETAILED EXPLANATION OF THE INVENTION

An object of this invention is to provide a spun yarn having increased yarn strength without unevenness of yarn.

Another object of this invention is to provide a blended spun yarn compossed of at least two kinds of staple fibers, with less unevenness of blend in the directions of radius and length of the spun yarn. Further, another object of this invention is to provide a covered yarn with less unevenness of finess of covering part of fiber bundle.

Further, another object of this invention is to provide a method for manufacturing above mentioned spun yarn directly from continuous multi-filament yarn.

The spun yarn of this invention is composed of substantially staple fibers only and the average number of fibers in cross section N and the rate of yarn evenness CV is within the range of $12.5 < CV\sqrt{N} < 100$. In the above equation the rate of yarn evenness CV is a coefficient of variation in evenness of finess as shown above, and, in more detail, is a value multiplied 1.25 by a value shown average variation value of evenness as percentage, in which the average variation value of evenness is measured at 25 m/min. by using asters yarn evenness tester in accordance with Japanese Industrial Standard JISL 1008, cotton yarn testing method 5.18.2, B,I.

Staple fibers to be used in this invention are those obtained by cutting continuous multi-filament yarn and preferably of polyamide or polyester type synthetic fibers. Effective fiber contents of the staple fibers to be used in this invention are preferably more than 25%.

The effective fiber contents are obtained as follows.

Staple fibers are arranged in order of their length, so called staple diagram is prepared. On the one end, the longest fiber is arranged and on the other end the shortest is arranged and the distance between them are divided into 50 equal parts.

Divided 49 points are accordingly made and the total fiber length on all of the divided points is measured. A value obtained by adding an average value of the longest fiber length and the shortest fiber length into the above total fiber length is divided by 50 to be an average fiber length $l$. The effective fiber contents are shown as percentage of the number of staple fibers within $0.8l \sim 1.2l$ length per the total number of staple fibers. Therefore, the better the uniformity of length of staple fibers, the higher the effective fiber contents.

The edges of staple fibers in the spun yarns of this invention is present randomly inside and on the surface of yarn.

Staple fibers composing spun yarn of this invention may be either non-crimped or coil-like crimped. Moreover, the spun yarn of this invention may be composed of at least two kinds of staple fibers, both of which are blended each other in the cross section of yarn.

In the above blended spun yarn, the average number of fibers, $N_1, N_2 \ldots$, and the rate of yarn evenness, $CV_1, CV_2 \ldots$, of each of staple fibers are as follows.

$$\frac{12.5}{\sqrt{N_1}} < CV_1 < \frac{100}{\sqrt{N_1}}$$

$$\frac{12.5}{\sqrt{N_2}} < CV_2 < \frac{100}{\sqrt{N_2}}$$

$$\vdots$$

In the above equations, the average number of fibers and the rate of yarn evenness are obtained by counting the number of fibers on optional 50 cross sections of spun yarn by means of microscope.

Moreover, this invention provides a composite yarn which is composed of staple fibers, having the average number of fibers in cross section, N, and the rate of yarn evenness, CV, being within the rate of $12.5 < CV\sqrt{N} < 100$, and other yarn. As the other yarn, mult-filament yarn, monofilament yarn, spun yarn, textured yarn, elastic yarn and the like can be used.

Covering yarn can be manufactured by using the above mentioned other yarn as the core yarn components. Spun yarn of this invention is manufactured as follows.

Substantially non-twisted continuous multi-filament yarn fed from a feed roller is contacted with a cutter moving approximately at right angles to yarn axis to be cut into staple-like fibers while maintaining the continuity of fiber bundle, and is discharged by means of delivery roller rotating at a same surface speed as the surface speed of feed roller, and then the fiber bundle thus obtained are gathered and taken up.

The starting material for manufacturing the yarn of this invention is continuous multi-filament yarn which is preferably non-twisted and each of continuous filaments is separated each other.

According to this invention, as the continuous filaments composed continuous multi-filament yarn are cut into staples, the continuity of fiber bundle composed of staple-like fibers thus produced is maintained. Therefore, it is preferable that the cut points of continuous filaments are dispersed as randomly as possible. For this reason, the continuous multi-filament yarn required to be non-twisted, and the multi-filament yarn having twist density of less then $100/m$ is preferably used.

In case that twist density is extremely higher than the above value or continuous filaments are tightly fixed each other with adhesive, resin or heat welding, only filaments exposed on the surface of continuous multi-filament yarn are cut, filaments existing in the center parts thereof are not cut to remain in the continuous state. Therefore, in such a case, the whole of continuous multi-filament yarn can not be cut into uniform staple-like fibers while continuity of fiber bundle is maintained.

The number of filaments composing continuous multi-filament yarn is preferably 15 or more. The more the filaments, the better the setting of the fiber bundle composed of staple-like fibers obtained.

In the above method, the ratio of surface speed of delivery roller (or second feed roller) to feed roller (or first feed roller) is usually within 1.01 - 1.20. Bending angle of the continuous multi-filament yarn resulted in contact with the cutter is usually within 15° - 45°. The cutter is preferably composed of a hollow cylindrical rotary device and the continuous multi-filament yarn is cut by contacting with the inner wall of said cylindrical rotary device.

The speed of the hollow cylindrical rotary device is preferably at least 1,000 rpm. As the supplying yarn, at least two kinds of substantially non-twisted continuous multi-filament yarn can be used or substantially non-twisted and non-crimped or spiral crimped continuous multi-filament yarn can also be used. Moreover in the above process, composite yarn can be manufactured by joining the cut fiber bundle together with other yarn fed from the delivery roller. In this case, covered yarn can be manufactured by feeding the other yarn in tensioned state higher than the cut fiber bundle. Also, stretch core yarn can be manufactured by using elastic fibers as the above other yarn. According to other embodiment of this invention, substantially non-twisted continuous multi-filament yarn is contacted, through feed roller, with a cutter moving approximately at right angles to yarn axis and cut into staple-like fibers while maintaining the continuity of fiber bundle, and is discharged by means of delivery roller at a speed approximately equal to the surface speed of feed roller, and the fiber bundle is introduced into a pot rotating at a high speed and twisted, and then at the time when the yarn contents in the pot reach at a predetermined level, the yarn deposited in the pot and the yarn continuously come into said pot are doubled discharged from the pot in twisted condition and taken up as a doubling and twisting spun yarn.

BRIEF DESCRIPTION OF THE DRAWING

FIG. 1 is a side view schematically illustrating one embodiment of the apparatus for practicing this invention. The continuous multi-filament yarn 2 taken up or the package 1 is supplied through the first feed roller 3 into the cutter 4 which is provided between the feed roller 3 and delivery rollers 5 the cut staple-like fiber bundle 2*a* being discharged by the delivery roller 5. Then, the cut staple-like fiber bundle 2*b* is supplied into the twisting machine 9 which is equipped with the ring 6, the spindle 7 and the traveler 8 and is take up as the pirn 10.

Figure 2:
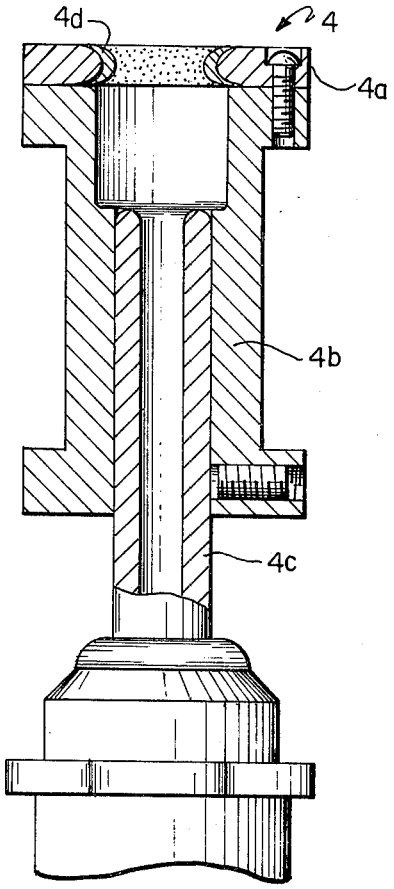
FIG. 2 shows a hollow cylindrical rotary cutter

As the cutter to be used in this invention, the hollow cylindrical rotary device as shown in FIG. 2 is preferably used. The hollow cylindrical rotary device 4*a* is connected with the hollow spindle 4*c* through the supporting device 4*b*.

The continuous multi-filament yarn is contacted with the inner surface of the hollow cylindrical rotary device 4*a*.

The portion of the cutter to contact with the continuous multi-filament yarn has an abrasive surface composed of far instance sand or the like having sharp edges.

The ratio of surface speed of the second delivery roller 5 to the first feed roller 3 is of important in order to cut the continuous filaments of continuous multi-filament yarn into good staple-like fibers, preferably ranges within 1.01 - 1.20. In case the ratio is less than 1.01, the cutting of filaments can not be attained sufficiently.

In case the ratio is more than 1.20, it is difficult to maintain the continuity of fiber bundle composed of staple-like fibers produced by cutting the continuous filaments of the continuous multi-filament yarn, and accordingly it becomes difficult to manufacture continuously the spun yarn.

If the ratio of less than 1.01 for instance 1 must be used, multi-filament yarn must be given such pretention before said yarn reaches at the feed roller as the same tention given to the multi-filament between the feed roller and delivery roller in the manner described above.

The rotating speed of the hollow cylindrical rotary device 4a and the bending angle of the continuous multi-filament yarn given in contact with the inner surface of hollow cylindrical yarn given in contact with the inner surface of hollow cylindrical rotary device are related to the cutting efficiency.

The rotating speed of hollow cylindrical rotary device is preferably at least 1,000 rpm. In case the rotating speed is less than 1,000 rpm., the cutting of filaments is insufficient. The bending angle is preferably within 15° - 45°. In case the angle is less than 15°, the cutting of filaments can not be attained sufficiently. In case the angle is more than 45°, the cutting points is centralized, and accordingly it is difficult to manufacture continuously the spun yarn and the strength of obtained spun yarn is remarkably lowered. According to this invention, substantially non-twisted continuous multi-filament yarn is cut by means of the hollow cylindrical rotary device and rollers into staple-like fibers and the product is discharged in the form of continuous fleece-like staple fiber bundle.

Figure 3:
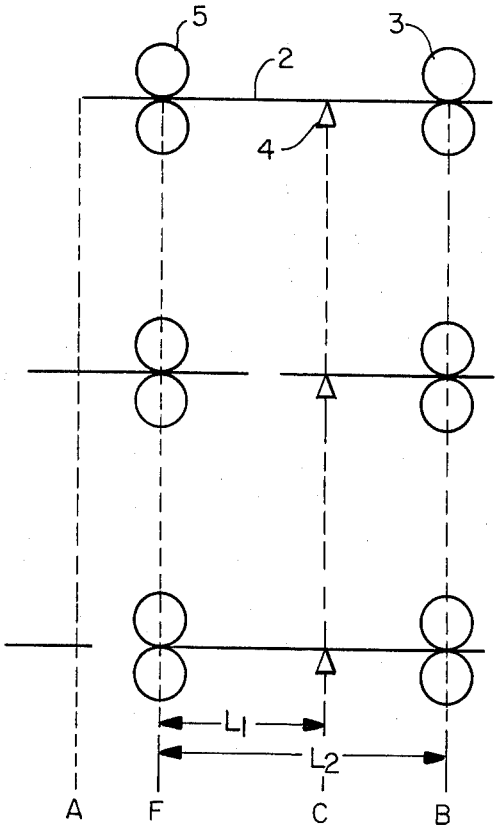
FIG. 3 schematically shows the cutting process of the invention

FIG. 3 shows briefly this cutting process. In FIG. 3, the step in which one of the continuous filaments is cut is shown and the thread line between the feed roller 3, and the delivery roller 5 is shown as a straight line in order to briefly explain.

a. Shows a state just prior to the cutting of continuous filament 2 by means of cutter 4. (hollow cylindrical rotary device) A shows the position of edge of filament produced in the preceding cutting. Supposing that the cutting position is *c* at which the filament is contacted with the cutter 4, the cut fiber length is equal to the distance AC.

b. Shows the fiber passage after cutting, the cut fiber on the delivery roller 5 side is transfered to the left by said roller at the same speed as said roller, and the fiber on the feed roller 3 side is also transfered to the left at the same speed as said roller 3. In this case, the edge of cut fiber is supported in straight form by friction with surrounding fibers.

c. Shows a state of the time when the edge of fiber on the feed roller 3 side reaches at the nipping point F of the delivery roller 5. A continuous multi-filament yarn 2 is nipped with both of the first feed roller 3 and the delivery roller 5, and begins to be elongated between both of nipping points F and B and becomes the state of a). The cut fiber length is equal to the distance between two rollers AC which is equal to the sum of the distance FC between the cutter 4 and the nipping point of delivery roller and the distance AF. The distance AF is equal to the length of continuous multi-filament yarn 2 transfered by the delivery roller 5 between the nipping by the delivery roller 5 and the cutting. This length AF depends on the ratio of surface speed of both rollers R, the distance between both rollers $L_2$, and the elongation of fiber at cutting $\epsilon$.

$$AF = L_2 \log e \frac{(R-1)(1+\epsilon)}{R-(1+\epsilon)}$$

The cut fiber length L is as follows, wherein the distance between the cutter 4 and the nipping point of the delivery roller 5, FC, is shown as $L_1$.

$$L = L_1 + L_2 \log e \frac{(R-1)(1+\epsilon)}{R-(1+\epsilon)}$$

The above equation was obtained in consideration of draft-cutting fiber length in tow spinning and the like but is also applicable to this invention. However, there is some difference between both methods. That is, in case of the draft-cutting in the known method, the cutting position of fibers are not constant, $L_1$ in the above equation accordingly changes widely, the draft corresponding to R in the above equation is extremely greater and the elongation of fiber at cutting is also greater than those of this invention. Therefore, the yarn obtained by the known method has unevenness of cut fiber length, unevenness of finess of fiber bundle and excessive shrinking percentage. The cutting device can also be arranged, shown in FIG. 4, so as to treat plural multi-filament yarns 2, in which plural cutting devices 4 are arranged between plural feed rollers and plural delivery rollers 5.

Figure 5:
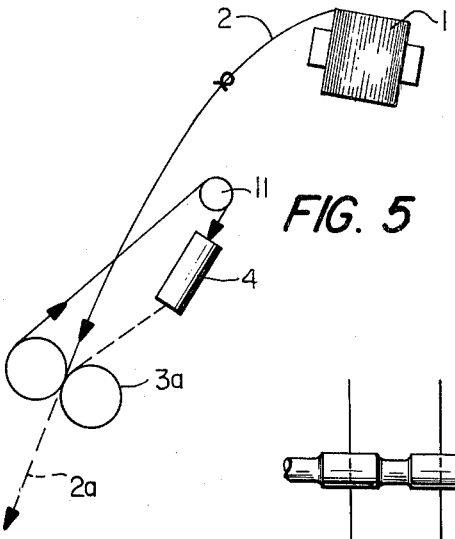
FIGS. 4–9 are illustrations of various arrangements suitable for carrying out the disclosed method.

In FIG. 5, feed roller 3a is used in place of the first and second feed rollers, the multi-filament yarn 2 is supplied, through the feed roller 3a, to the guide roller 11, and is cut by the cutter 4 prior to again reaching at the feed roller 3a and then is discharged as staple fiber bundle. As the means for joining fibers in the yarn form, twisting method by ring traveler system, twisting method by open-end spinning system, self-twisting method or adhesive method combining false twisting and heat adhesion can be used. As the non-twisted continuous multi-filament yarn to be used in this invention, crimped yarn such as false twisted yarn can be used. This crimping process can be incorporated to the process for manufacturing spun yarn of this invention.

The process for manufacturing the spun yarn in this invention can be incorporated into the process for manufacturing the continuous multi-filament yarn of the starting material.

Also, as the continuous multi-filament yarn, yarn composed of different components can be used, for example, different kinds of fibers, different filaments, different crimped forms or different shrinking percentage can be used.

Figure 4:
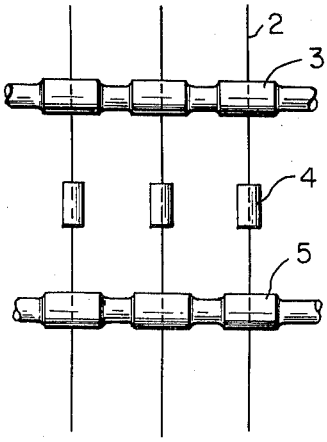

As is shown in FIG. 4, using plural cutters arranging in a row, the cut fiber bundles each of which have different fiber length can be joined to produce blended spun yarn.

Figure 6:
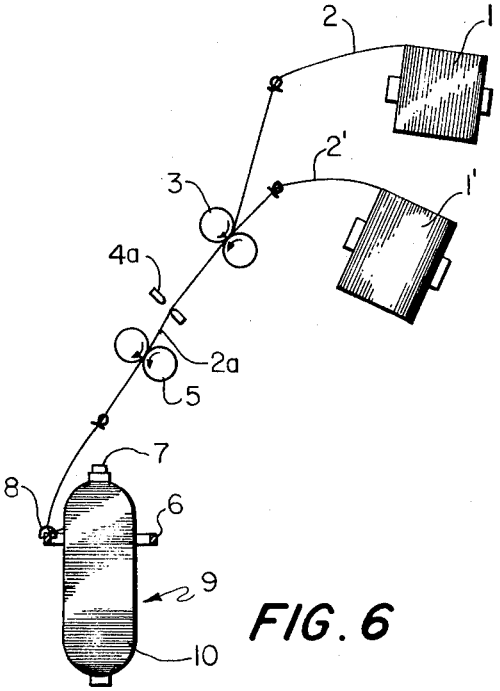

FIG. 6 is a drawing showing one embodiment of the apparatus for manufacturing the blended spun yarn in this invention.

Different kinds of continuous multi-filament yarns 2, 2' taken up on the package 1, 1' are put in order, are supplied through the feed roller 3 into the hollow cylindrical device 4a which is provided between the first feed roller 3 and the delivery roller 5 to be cut into staple-like fibers, and are blended by changing the relative situation of the bundles each other, and the blended fiber bundle 2a is discharged by the delivery roller 5. Then, the fiber bundle 2a thus produced is supplied into the twisting device 9 which is equipped with the ring 6, the spindle 7 and the traveler 8 to be twisted and is taken up on the pirn 10.

Figure 7:
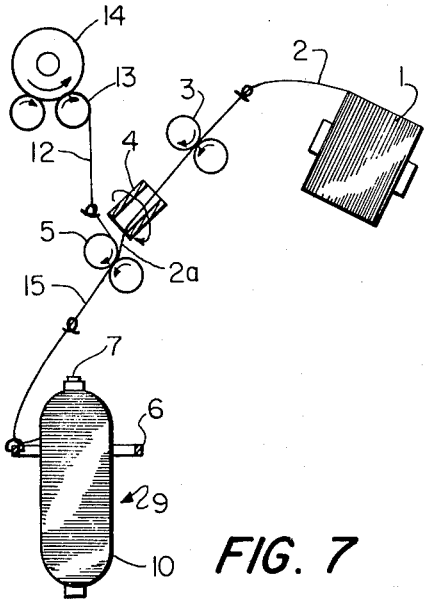

FIG. 7 is a drawing showing one embodiment of the apparatus for manufacturing the covered spun yarn in this invention.

The continuous multi-filament yarn 2, which is a starting material for covering part, is supplied through the first feed roller 3 into the hollow cylindrical device 4 and delivered through the delivery roller 5.

The other yarn 12, which is a starting material for core part, is supplied by the third feed roller 13 from the package 14 and is joined with the fiber bundle 2a at the second feed roller 5.

The joined bundle is delivered from the second feed roller 5, and is twisted by the spindle 7 and the ring traveler 9, and is taken up on the pirn 10 as the covered yarn. In this case, the other yarn 12 is preferably supplied in tensioned state higher than the fiber bundle 2a. As the other yarn, elastic yarn such as polyurethan yarn can be used.

Covered yarn having high stretchability can be obtained by supplying the elastic yarn in tensioned state from the delivery roller 5.

Figure 8:
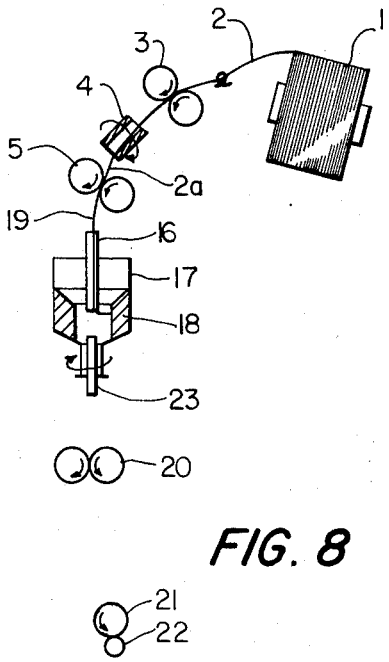
Figure 9:
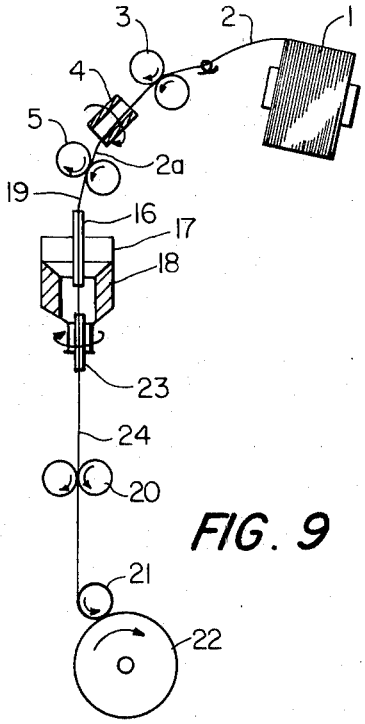

FIG. 8 and FIG. 9 are side views showing one embodiment of the apparatus for manufacturing two folded yarn in this invention.

The continuous multi-filament yarn 2 is supplied from the package 1 trough the feed roller 3 into the cutter 4 which is provided between the feed roller and delivery feed rollers 3, 5. The cut staple-like fiber bundle 2a is delivered by the second feed roller 5 and is introduced through the yarn guide pipe 16 into the pot 17 rotating at a high speed.

The yarn guide 16 is in reciprocating motion so as to make uniform yarn layer 18 in the pot 17.

The yarn 19 guided into the pot 17 is pressed against the inner surface by centrifugal force to form the yarn layer 18 and is twisted by means of the rotation of pot 17. In the figure, 20 is the take up roller, 21 is the taking up drum and 22 is the taking up bobbin.

In the above mentioned operation, the yarn layer 18 is increased with time, and at the time when the yarn layer reaches at a predetermined level or after a predetermined time from starting storage of the yarn in the pot 17, the yarn of yarn passage between the yarn guide pipe 16 and the yarn layer 18 is discharged downwards through the yarn discharge pipe 23 and is taken up through the take up roller 20 on the bobbin 22 by means of the taking up drum 21. (FIG. 9).

In this case, the direction of yarn discharged from the yarn layer 18 stored in the pot 17 is reversed, and accordingly the yarn is reversely twisted and discharged together with the yarn 19 supplied by the yarn guide pipe 16 through the yarn discharge pipe 23. As is mentioned above, the two folded yarn is obtained, and at the time when the yarn layer 18 in the pot 17 is out, discharging of the two folded yarn from the yarn discharge pipe 23 is stopped and the storage of yarn into the pot 17 is again started.

Repeating the above mentioned steps, the two folded yarn 24 of spun yarn is manufactured directly from the continuous multi-filament yarn 2.

Advantages of this invention can be summarized as follows.

1. the spun yarn of this invention has excellent uniformity of thickness as shown that the average number of fibers in cross section, N, and the rate of yarn evenness, CV are within $12.5 < CV\sqrt{N} < 100$, and accordingly the knitted and woven fabrics has excellent uniformity of surface, the manufacture of knitted and woven fabrics can be produced quite efficiently and the knitted and woven fabrics having high gauge which can not be attained by the conventional spun yarns can be manufactured.
2. the spun yarn of this invention is composed of staple fibers which effective fiber contents are more than 25%, and accordingly shows sufficient strength and there is less scattering of short fibers at the knitted process or the like.
3. the edges of staple fibers composing the spun yarn of this invention exist inside and on the surface of the yarn, and accordingly the knitted and woven fabrics having high bulkiness, softness and warm hand touch can be manufactured.
4. the spun yarn of this invention can be composed of non-crimped staple fibers, and accordingly the spun yarn having smooth luster which can not be attained by the conventional methods can be manufactured.
5. the spun yarn of this invention can be composed of coil-crimped staple fibers, and accordingly the spun yarn having excellent bulkiness and stretchability which can not be attained by the conventional methods can be manufactured.
6. the spun yarn of this invention can be composed of at least two kinds of staple fibers, having less unevenness of blend in the directions of radius and length of the spun yarn, and accordingly the feature of spun yarn obtained by blending different kinds of fibers can be sufficiently exhibited, for instance, in case of blending different colored fibers, nature color can be obtained,
   in case of blending fibers of different shrinkage, bulky yarn having uniform and higher bulkiness can be manufactured,
   in case of blending fibers of different fiber fineness, higher bulkiness, softness and resilience can be obtained,
7. the covered yarn obtained by this invention has the continuous multi-filament yarn as a starting material for fibers composing the covering part thereof, and accordingly the fiber bundle composing the covering part has less unevenness of thickness, the knitted and woven fabrics therefrom has uniform surface and the manufacture of knitted and woven fabrics can be conducted quite efficiently,
8. according to the method of this invention, the spun yarn can be manufactured directly from the continuous multi-filament yarn, and accordingly the rationalization relating to equipment, workers required and electric power required can be attained,
9. according to the method of this invention, the cut points of each of the continuous filaments are randomly dispersed inside and on the surface of yarn along the axis direction of the yarn and the effective fiber contents of staple fibers in the obtained spun yarn are quite high, and accordingly the obtained spun yarn has high strength and high uniformity of finess, nap on the yarn surface and strength, and troubles such as yarn breakage in the manufacture of spun yarn are remarkably lowered,
10. according to the method of manufacturing the blended spun yarn of this invention, the blended spun yarn can be manufactured directly from at least two kinds of the continuous multi-filament yarns, and accordingly the rationalization relating to equipment, workers required and electric power required can be attained,
11. according to the method of manufacturing the blended spun yarn of this invention, the cut points of each of continuous filaments are randamly dispersed inside and on the surface of yarn along the axis direction of the yarn and the staple fibers are blended each other in the cross section of spun yarn, and accordingly troubles such as yarn breakage in the manufacture of blended spun yarn are remarkably lowered, 12. according to the method of manufacturing the covered yarn of this invention, the covered yarn can be manufactured directly from the continuous multi-filament yarn for the covering part and the other yarn for the core part, and accordingly the rationalization relating to equipment, workers required and electric power required can be attained, and moreover the covered yarn having covering fiber bundle the average number of fibers in cross section of which is smaller than that in the conventional methods can be manufactured, and accordingly the excellent properties of core yarn can be best exhibited, and 13. according to the method of manufacturing the two folded yarn of this invention, the cheese composed of two folded yarn can be manufactured directly from the continuous multi-filament yarn, and accordingly the process can be remarkably simplified, and the obtained two folded yarn has remarkably high uniformity and the yarn breakage in the spinning process can be almost completely prevented, The features of this invention will be more apparent from the following examples.

EXAMPLE 1

Figure 1:
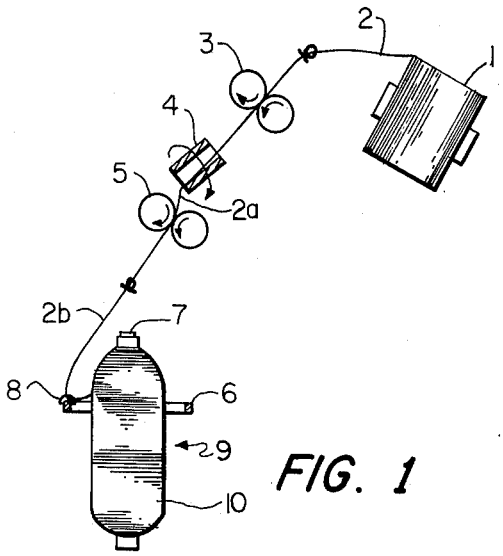
FIG. 1 is a schematic illustration of apparatus for practicing this invention.

In FIG. 1, the continuous multi-filament yarn 2 is fed from the package 1 by the feed roller 3 into the cutter 4 and then through the delivery roller 5 into the twisting device 9, the twisted spun yarn 2b thus produced is taken up on the pirn 10.

The cutter 4 is, as shown in FIG. 2, equiped with the rough surface 4d which was prepared by electrically coating diamond powder of an average diameter of 20μ onto the inner surface of outlet of the hollow cylindrical rotary device 4a.

The cutter 4 was rotated in the direction of arrow in FIG. 1 and cut the continuous multi-filament yarn 2 passing through the hollow part into staple-like fibers to produce the fleece-like fiber bundle 2a.

During this cutting operation, the straight and parallel state of fibers composing bundle was preferably maintained, and the fiber bundle 2a was discharged by the delivery roller 5.

The above method was conducted by using woollie processed polyester filament yarn (150 deniers, 48 filaments) at the surface speed of first feed roller of 19.2 m/min. and the surface speed of second feed roller of 20 m/min. at the rotation of cutter 4 of 8,000 times/min. and at the rotation of spindle 4c of 9,000 times/min.

The obtained spun yarn had the rate of yarn evenness, CV%, of 6.3%, the average fiber length of fibers composing the yarn of 82 mm and the maximum fiber length of 210 mm.

For the purpose of comparison, woolie polyester yarn (150 deniers, 48 filaments), polyester filament yarn (150 deniers, 48 filaments) and spun yarn composed of polyester staple fibers (1.5 denier, 44 mm cut) manufactured according to the conventional method were prepared.

The rate of yarn evenness, CV, $CV\sqrt{N}$, and the specific volume of the spun yarns thus obtained were measured.

The specific volume was calculated from the diameter and yarn weight of cheese.

The test results are as follows.

| Sample | CV | $CV\sqrt{N}$ | Specific volume |
|---|---|---|---|
| spun yarn of this invention | 6.9 % | 49 | 2.37 cc/g |
| Filament yarn | 0.54 | 3.8 | 1.43 |
| woolie yarn | 1.05 | 7.3 | 1.87 |
| spun yarn by conventional method | 16.5 | 166 | 1.94 |

The CV value of spun yarn of this invention was 6.3% while that of the conventional spun yarn was 16.5%, and the $CV\sqrt{N}$ value of spun yarn of this invention was remarkably lower than that of the conventional spun yarn. On the other hand, the specific volume of spun yarn of this invention was 2.37 cc/g while that of the conventional spun yarn was 1.94 cc/g. These test results show that the spun yarn of this invention has excellent bulkiness and uniformity.

Plain knittings of the above mentioned samples were conducted by means of circular plain knitting machine having 28 gauges.

In case of the conventional spun yarn, yarn breakage occured frequently and the obtained knitted fabrics had many defects. The other yarns were smoothly knitted and the obtained knitted fabrics thereby had no defect. Using the knitted fabrics made of three kinds of yarns other than the conventional spun yarn, shirts and blouses were sewed. The knitted fabrics made of filament yarn or woolie yarn were not suitable because of no feeling of thick cloth and of unpleasant feeling being stick to skin, but the knitted fabrics made of spun yarn of this invention was quite suitable because of feelings of softness and high quality of the surface.

EXAMPLE 2

The procedures in Example 1 were conducted by changing variously the ratio of speed of the first feed roller 3 and the delivery roller 5, the set position of cutter 4, the inner diameter there of and the particle size of diamond powder therein.

For the purpose of comparison, the spun yarns thus obtained and the other three kinds of spun yarns (sample Nos. 8– 10) manufactured according to the conventional card and direct spinning systems were knitted by means of circular plain knitting machine having 28 gauges.

The test results relating to efficiency of knitting, quality and hand touchness of the knitted fabrics are as follows.

Sample Nos. 1, 3 and 10 were also tested in Example 1.

| Sample No. | CV | $CV\sqrt{N}$ | efficiency of knitting | quality | hand touchness |
|---|---|---|---|---|---|
| 1 | 1.05% | 7.3 | O | O | X |
| 2 | 6.1 | 43 | O | O | O |
| 3 | 6.9 | 49 | O | O | O |
| 4 | 8.3 | 58 | O | O | O |
| 5 | 11.5 | 79 | O | O | O |
| 6 | 13.0 | 90 | O | O | O |
| 7 | 15.4 | 106 | X | Δ | O |
| 8 | 11.9 | 113 | O | O | X |
| 9 | 14.9 | 149 | Δ | Δ | X |
| 10 | 16.5 | 166 | X | X | X |

In the table, O means excellent, Δ means good or allowable and X means bad. Sample No. 1 had excellent efficiency of knitting and quality of the knitted fabrics but less bulkiness and softness of surface. Sample Nos. 8– 10 were able to knit so far as obtaining a small amount of knitted fabrics but had less quality and hand touchness.

EXAMPLE 3

In the process shown in FIG. 7, using woolie polyester filament yarn (150 deniers, 72 filaments) as the continuous multi-filament yarn for the covering part and polyurethane elastic yarn (30 deniers) as the yarn for the core part, the covered yarn was manufactured.

the surface speed of feed roller 3: 13.1 m/min.

the surface speed of delivery roller 5: 13.8 m/min.

the surface speed of third feed roller 13: 5.5 m/min.

the rotation number of spindle: 11,000 rpm.

the rotation number of cutter: 5,500 rpm.

The covered yarn thus obtained had excellent uniformity and stretchability and the poor covering portion was not recognized.

EXAMPLE 4

According to the process shown in FIGS. 8 and 9, two folded yarn was manufactured.

the continuous multi-filament yarn: woolie polyester yarn (150 deniers, 48 filaments) the surface speed of feed roller 3: 19.2 m/min.

the surface speed of delivery roller 5: 20 m/min.

the cutter: electrically coated diamond powder of 800 mesh on the inner surface 4 of cutter having inner diameter of 10mm. the rotation number of cutter 5: 6,000 rpm.

the rotation number of pot 17: 8,000 rpm.

The two folded yarn thus obtained had excellent uniformity and finness. There was no yarn breakage in the spinning process.

What we claim is:

1. A spun yarn composed only of staple fibers in which the product of the degree of yarn evenness, CV, and the square root, $\sqrt{N}$, of the average number of fibers in a cross section of said yarn is a value between 12.5 and 100, and the effective fiber content of said staple fibers is over 25%.

2. A spun yarn according to claim 1, in which ends of individual staple fibers exist both inside and on the surface of the yarn.

3. A spun yarn according to claim 1, in which the staple fibers are non-crimped staple fibers.

4. A spun yarn according to claim 1, in which the staple fibers are coil-crimped staple fibers.

5. A spun yarn according to claim 1, in which the spun yarn is composed of at least two kinds of staple fibers.

6. A spun yarn according to claim 5, in which the different kinds of staple fibers are blended with each other throughout the cross section of yarn.

7. A spun yarn according to claim 5, in which the respective average number of fibers of different kind of fibers in cross section, $N_1$, $N_2$, . . . . , and the respective rate of yarn evenness of different kind of fibers, $CV_1$, $CV_2$, . . . . , of are, within $$\frac{12.5}{\sqrt{N_1}} < CV_1 < \frac{100}{\sqrt{N_1}}$$

$$\frac{12.5}{\sqrt{N_2}} < CV_2 < \frac{100}{\sqrt{N_2}}.$$

$$\vdots$$

* * * * *